US007508348B2

(12) United States Patent
Abdul-Gaffoor et al.

(10) Patent No.: US 7,508,348 B2
(45) Date of Patent: Mar. 24, 2009

(54) DUAL ANTENNA STRUCTURE FOR AN ELECTRONIC DEVICE HAVING ELECTRICAL BODY BIFURCATION

(75) Inventors: Mohammed R. Abdul-Gaffoor, Palatine, IL (US); Eric L. Krenz, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 375 days.

(21) Appl. No.: 11/317,544

(22) Filed: Dec. 23, 2005

(65) Prior Publication Data

US 2007/0146211 A1 Jun. 28, 2007

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 5,977,916 A * 11/1999 Vannatta et al. ..... 343/702
7,199,762 B2 4/2007 Liu et al.
2007/0052596 A1 * 3/2007 Liu et al. ..... 343/702

* cited by examiner

*Primary Examiner*—HoangAnh T Le
(74) *Attorney, Agent, or Firm*—Philip H. Burrus, IV

(57) ABSTRACT

An electronic device, such as a mobile radiotelephone, includes a dual antenna structure with a selectively actuatable phase shifter disposed therebetween. When the selectively actuatable phase shifter is selected, signals received by the first and second antennas are substantially out of phase. When the selectively actuatable phase shifter is not selected, signals received by the first and second antennas are substantially in phase. The dual antennas are coupled to a first electrical circuit disposed in a first section of the device. A second electrical circuit is disposed within a second section of the device. An impedance element, for example an inductor, couples the first and second electrical circuits and is disposed in a substantially symmetric location between the first and second electrical circuits. Working in combination, when the selectively actuatable phase shifter is selected, an antenna pattern of the device becomes substantially azimuthal with a null at a top central location. When the selectively actuatable phase shifter is not selected, the antenna pattern becomes substantially uniform with a zenith atop the upper lobe.

20 Claims, 5 Drawing Sheets

DUAL ANTENNA STRUCTURE FOR AN ELECTRONIC DEVICE HAVING ELECTRICAL BODY BIFURCATION

BACKGROUND

1. Technical Field

This invention relates generally to antenna structures for portable electronic devices, and more particularly to an inverted antenna structure for a mobile device having selectably one of a uniform antenna coverage pattern and a uniformly azimuthal antenna coverage pattern in the upper hemisphere.

2. Background Art

Portable electronic devices, like mobile telephones for example, employ one or more antennas for transmission and reception of radio frequency (RF) signals to and from other devices and network base stations. These antennas each have a characteristic "antenna pattern" that describes from which directions the antennas are best suited to transmit and receive signals. For optimal performance, these antenna patterns should be shaped such that they extend outward towards the devices with which they communicate. For devices like mobile telephones, the antenna patterns should generally be directed outward from a user, as the towers to which the mobile telephone sends and receives signals are generally a few hundred feet off the ground.

In certain applications however, like mobile devices that receive signals from satellites orbiting the earth, the traditional cellular antenna patterns are not optimal. For instance, devices that include Global Positioning Systems (GPS) require different antenna patterns to reliably receive signals from satellites. When such a device is outdoors, the satellites, of course, are orbiting overhead. As such, an optimal antenna pattern should extend predominantly upwards and should be substantially uniform. When the device is indoors, however, satellite signals generally enter through the windows. The outdoor pattern, i.e. a pattern pointing upward and substantially uniform, may not be optimum for signals entering through windows. A different indoor pattern, suitable for receiving signals that enter buildings through windows, is required.

Prior art mobile telephone antenna structures often fail to provide adequate uniformity to reliably receive satellite signals both indoors and out. For instance, traditional mobile telephones that have either retractable or stub antennas extending from a portion of the telephone tend to have antenna patterns that do not change. In other words, the antenna pattern is the same indoors as out. Further, devices that include additional antenna structures in an attempt to be satellite compatible may have upward pointing antenna patterns, but they are rarely uniform. This is especially true when the device is being held next to the body of a user.

There is thus a need for an improved antenna structure having a substantially upward pointing, uniform antenna pattern so as to be compatible with satellite signal reception.

Figure 1:
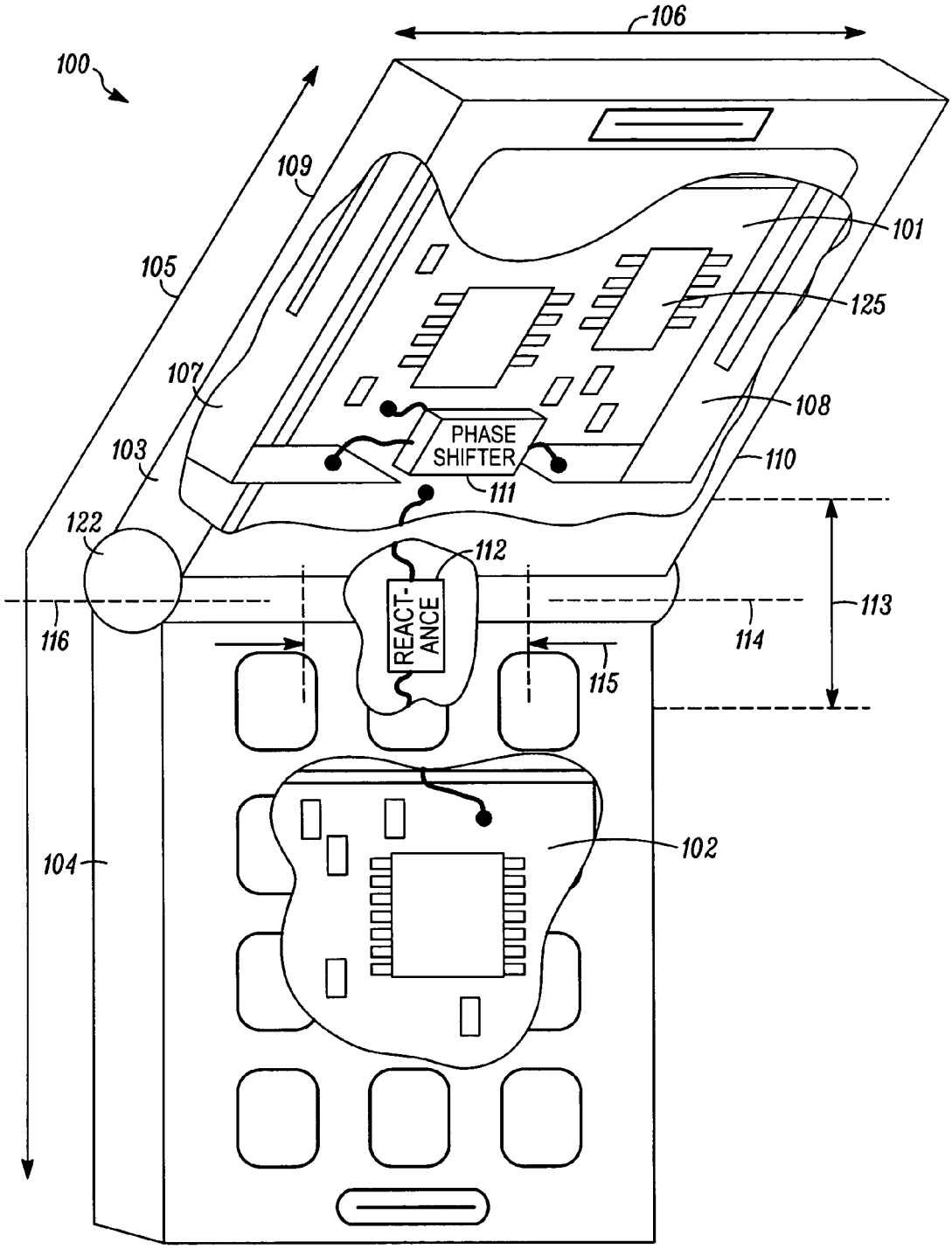
FIG. 1 illustrates one embodiment of an electronic device having an antenna structure and corresponding circuitry in accordance with the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to providing an antenna structure suitable for providing an antenna pattern that is substantially uniform and upwardly projecting. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

It will be appreciated that embodiments of the invention described herein may be comprised of one or more conventional processors and unique stored program instructions that control the one or more processors to implement, in conjunction with certain non-processor circuits, some, most, or all of the functions of an electronic device utilizing an antenna structure in accordance with the invention. The non-processor circuits may include, but are not limited to, a radio receiver, a radio transmitter, signal drivers, clock circuits, power source circuits, and user input devices. As such, these functions may be interpreted as steps of a method to perform the functions of an electronic device employing an antenna structure in accordance with the invention. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." In this document, relational terms such as first and second, top and bottom, and the like may be used solely to distinguish one entity or action from another entity or action without necessarily requiring or implying any actual such relationship or order between such entities or actions.

In accordance with the invention, an electronic device, like a hand-held radiotelephone for example, includes an upper housing with an upper electrical circuit and a lower housing having a lower electrical circuit. The upper housing and lower housing, in one embodiment, are joined by a mechanical connection. By way of example, in a hinged, "flip phone" the upper housing may include a display and a loudspeaker. The lower housing may include a microphone assembly and keypad. In the example of a flip phone, a hinged connector joins the upper housing and lower housing.

An upper electrical circuit, which includes the printed circuit board assembly and associated circuitry for operating, for instance, the display driver, audio circuitry and other upper housing functions, is disposed in the upper housing. A lower electrical circuit, which includes another printed circuit board assembly and associated circuitry for coupling to the keypad and other components residing in the lower housing is disposed in the lower housing.

A first antenna is coupled to the upper electrical circuit. The first antenna is disposed along an outer edge of the upper housing. A second antenna is also coupled to the upper circuit, and is disposed along a second outer edge opposite the first. A selectable phase shifter is coupled between the first antenna and the second antenna.

The selectable phase shifter is "selectable" in the sense that circuitry disposed on either the upper electrical circuit or the lower electrical circuit, like a microprocessor or other controller for example, can selectively actuate the phase shifter. When the selectable phase shifter is not selected, signals received by the first antenna and second antenna are combined substantially in phase. Where the selectable phase shifter is selected, signals received by the first antenna are combined out of phase with signals received by the second antenna by a predetermined amount. The predetermined amount can vary by application, but in one embodiment the selectable phase shifter shifts the phase by between 90 and 270 degrees. Suitable devices for the phase shifter include transmission lines, baluns and signal processors, SPDT switches and equivalent devices.

In accordance with the invention, a reactance, like an inductor for example, couples the upper electrical circuit and the lower electrical circuit about the mechanical connector. In one embodiment, the reactance element is disposed at a central location along a width of the device. Said differently, viewing the device straight on, the reactance element is disposed at a central location relative to the right and left edges of the device. The reactance element serves as an electrical load that impedes high frequency currents passing between the upper electrical circuit and the lower electrical circuit.

The combination of the first antenna and second antenna, each on an edge of the upper housing, where the selectable phase shifter is not selected and a reactance element coupling the upper and lower electrical circuits yields a combined antenna pattern that is doughnut shaped in the upper hemisphere. In other words, it is uniformly azimuthal with a null center at the top. Such a pattern is desirable, for example, for GPS devices operating indoors.

When the selectable phase shifter is selected, the combination of antennas, with each antenna out of phase from the other, along with the reactance element in a symmetrical location across the width of the device, yields a combined antenna pattern that has a peak at its zenith and a substantially uniform pattern. Such an antenna pattern is desirable, for example for GPS reception outdoors.

Turning now to FIG. 1, illustrated therein is one embodiment of a portable electronic device 100 having an antenna structure and associated circuitry in accordance with the invention. The device 100 includes a first electrical circuit 101 disposed in the first, upper housing 103 and a second electrical circuit 102 disposed in a second, lower housing 104 of the device 100. The overall housing of the device 100 includes a major axis 105 running the length of the device 100, and a minor axis 106 running the width of the device 100.

A first antenna 107 is disposed substantially parallel to the major axis 105 along an outer portion 109 of the device 100. A second antenna 108 is disposed substantially parallel to the major axis 105 along a distal outer portion 110 of the device. In one embodiment, the first antenna 107 and the second antenna 108 are each selected from the group consisting of monopoles and inverted F structures. The two antennas 107, 108 are employed to receive radio frequency signals and to deliver them to circuit components on either the first electrical circuit 101 or second electrical circuit 102, depending upon the configuration of the particular device. When operating in a first mode, signals incident upon the two antennas 107,108 are combined substantially in phase for further processing by the receiver circuitry.

In one embodiment, a selectively actuatable phase shifter 111 is coupled between the first antenna 107 and second antenna 108. The selectively actuatable phase shifter 111, which may be a switch driven balun, transmission, mixer, signal processor or other phase shifting device, is capable of phase shifting a signal received by the first antenna 107 relative to a signal received by the second antenna 108 by a predetermined amount when the device is operating in a second mode. The predetermined amount, which causes the first signal and second signal to be combined out of phase, in one embodiment, is between 90 and 270 degrees. When the selectively actuatable phase shifter is actuated, the device operates in a second mode where a phase shift of between 90 and 270 degrees is introduced between the first antenna and the second antenna.

A complex impedance element 112 couples the first electrical circuit 101 and the second electrical circuit 102. In the illustrative embodiment of FIG. 1, the electronic device is a flip style radiotelephone. As such, the first, upper housing 103 and the second, lower housing 104 are joined by a separating mechanism 122. As will be seen in other embodiments below, this separating mechanism 122 need not be a mechanical connector. It may be any electrical bifurcation where substantive electrical components within the device are separated such that some electrical separation exists. Where the separating mechanism 122 is a mechanical connection, it may be any of sliding connectors, rotating connectors and hinged connectors.

In the illustrative flip style embodiment, the separating mechanism 122 comprises a mechanical connector that is a hinge. As shown in FIG. 1, the separating mechanism 122, or mechanical connector, is disposed at a central location 115 along a line 114 that is substantially parallel to the minor axis 106. The separating mechanism 122 is, of course, between the first, upper section 103 and the second, lower section 104 so that each section is roughly symmetric when the flip is closed. In one embodiment, the separating mechanism 122 is non-conducting, such that currents pass through the complex impedance element 112 and not the separating mechanism 122 itself.

As noted above, the device 100 may operate in either a first mode, where signals incident on the antennas 107,108 are combined substantially in phase, and a second mode where signals incident on the antennas 107,108 are combined substantially out of phase by the selectively actuatable phase shifter 111. The device 100 selects between the first mode and the second mode based upon a criterion selected from a quality of service indicator, a strength of signal indicator, an environmental sensor and a user input. Said differently, a detector module 125, disposed on either the first electrical circuit 101 or the second electrical circuit 102 may detect various characteristics to determine whether they meet a predetermined criterion. If so, the device 100 will select one mode. If not, the device 100 will select another.

By way of example, the device 100 (or more particularly a processor or controller disposed within the device) may measure the strength of a signal being received by either of the antennas 107,108. Where this received signal has a strength that is below a predetermined threshold, this may be indicative of the device 100 being indoors. As such, the device 100 may deactuate the selectively actuatable phase shifter 111 so as to cause the overall antenna pattern to become azimuthal with a null central node at the top. Where the signal is above a predetermined threshold, the device 100 may actuate or continue to work in the second mode, thereby causing the overall antenna pattern to be uniform with a peak at the zenith.

Figure 2:
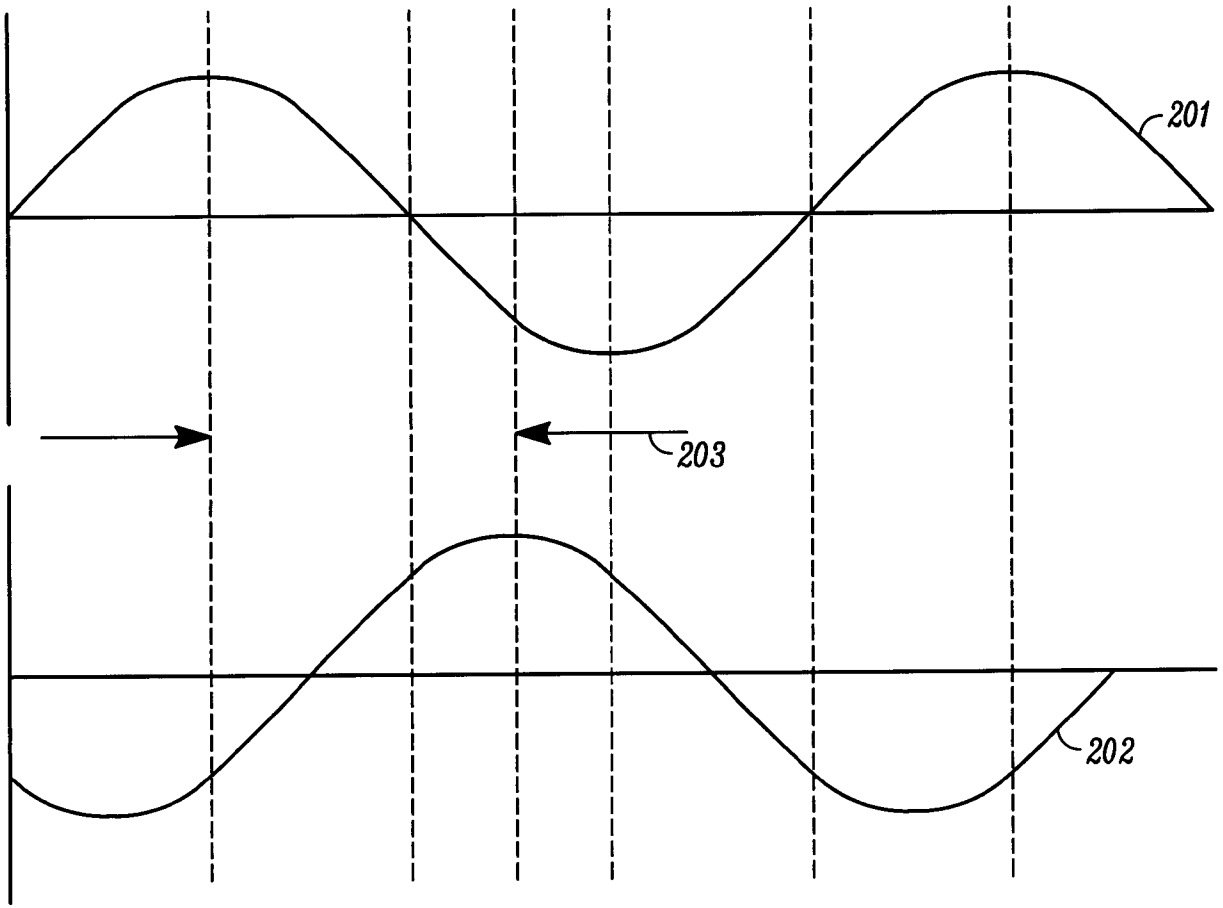
FIG. 2 illustrates exemplary signals received by antennas that have been phase shifted by a predetermined amount in accordance with the invention.

As mentioned above, where the selectably actuatable phase shifter 111 is actuated, a phase shift is introduced between signals received by the first antenna 107 and the second antenna 108. This phase shift may be between, in one embodiment, 90 and 270 degrees. Turning briefly to FIG. 2, illustrated therein is a graphical representation of this phase shift. A first signal 201, perhaps received by the first antenna (107) has a magnitude and phase. A second signal 202, perhaps received by the second antenna (108) and shifted by the selectively actuatable phase shifter (111), is out of phase with the first signal 201 by a predetermined phase shift 203. In one embodiment, the predetermined phase shift 203 is such that the phase shift introduced causes the first signal 201 and second signal 202 to be substantially out of phase. Stated numerically, the predetermined phase shift 203 is between approximately 170 and 190 degrees in one embodiment.

Turning back to FIG. 1, the impedance element 112 will be examined in more detail. More particularly, the type and location of the impedance element 112 will be examined. As the currents passing between the first electrical circuit 101 and the second electrical circuit 102 are generally high frequency currents, in one embodiment, the impedance element 112 is a reactance element. The reactance element acts as a damper or load between the first electrical circuit 101 and the second electrical circuit 102. Experimental testing has shown that by varying the impedance of the impedance element 112 with the width (illustrated by the minor axis segment 106), improved uniformity in antenna pattern may be achieved. Thus, in one embodiment, where the impedance element 112 comprises an inductance, the inductance is selected based upon the width of the device. The wider the device, the lower the inductance.

The impedance element 112 is disposed at a central location 115 along an electrical circuit separation line 116 that runs substantially parallel to the minor axis 106. The electrical circuit separation line 116 is simply a reference line passing through the device 100. The disposition of the impedance element 112 at a central location 115 provides a symmetric load for the currents passing between the first electrical circuit 101 and the second electrical circuit 102.

In numerical terms, the central location 115 may be between 25% and 75% of the way across the electrical circuit separation line 116. Experimental results have shown effective uniform antenna patterns where the impedance element 112 is disposed substantially at a center of the electrical circuit separation line.

Figure 3:
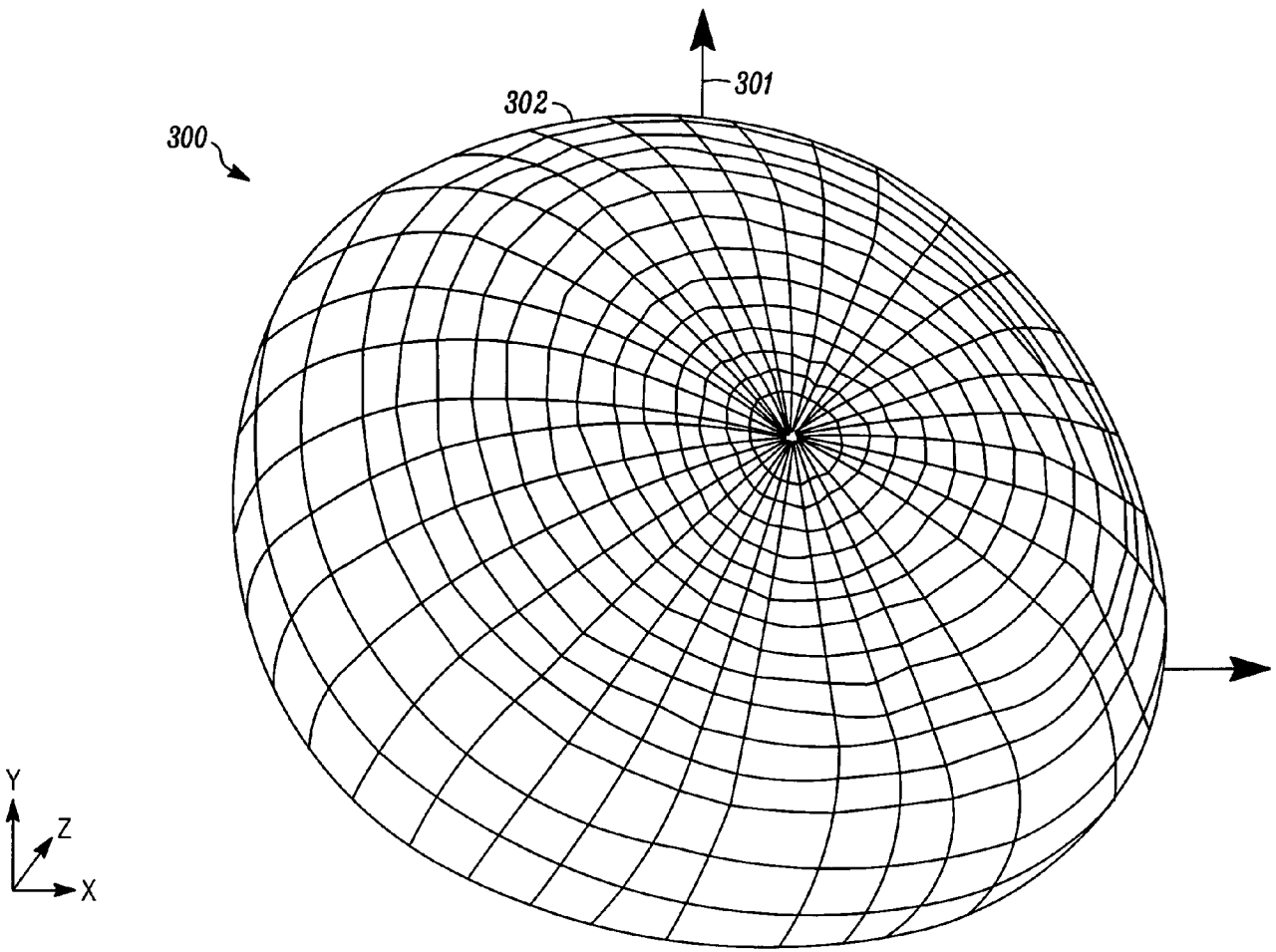
FIG. 3 illustrates an antenna pattern associated with an antenna structure and associated circuitry in accordance with the invention where a selectively actuatable phase shifter has been selected.
Figure 4:
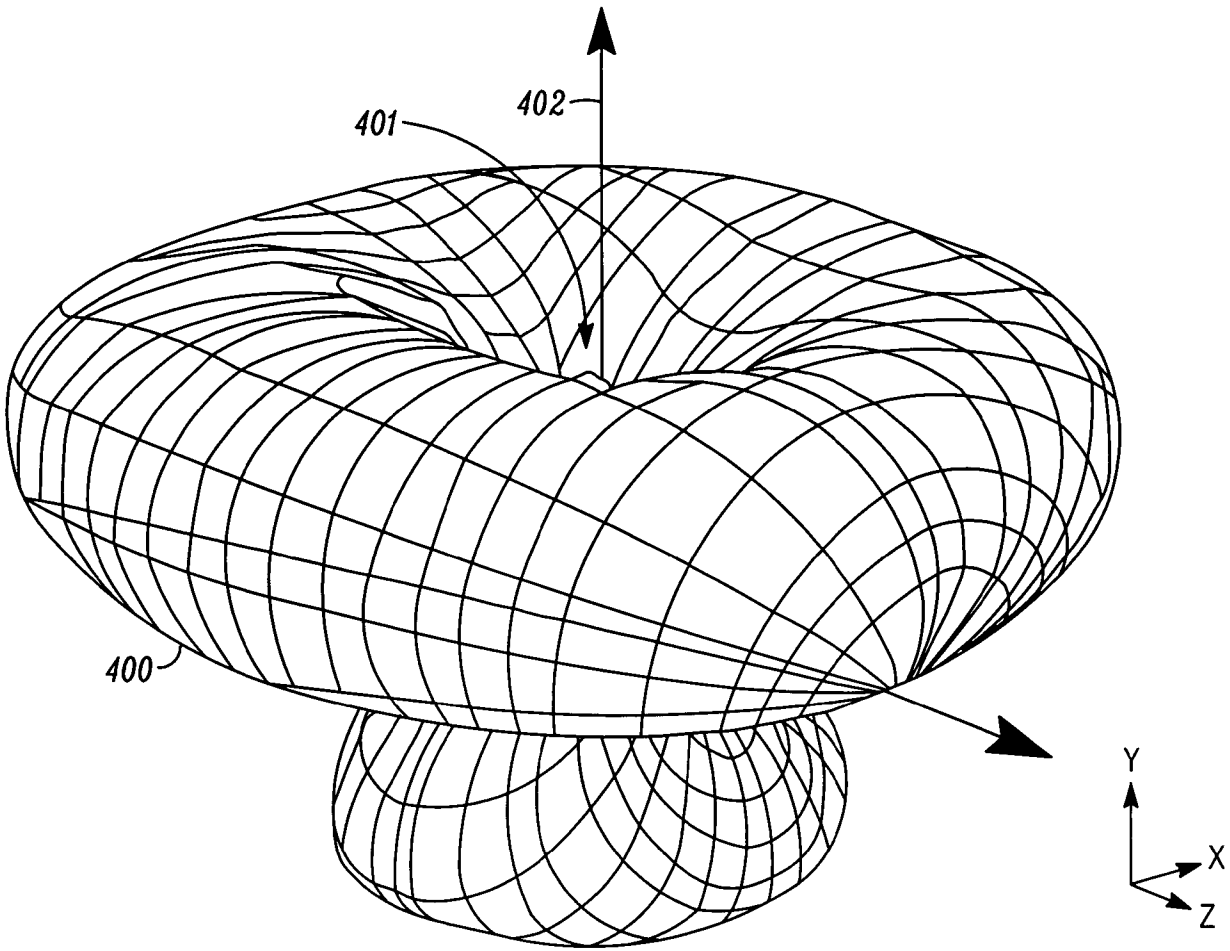
FIG. 4 illustrates an antenna pattern associated with an antenna structure and associated circuitry in accordance with the invention where a selectively actuatable phase shifter has not been selected.

Turning now to FIGS. 3 and 4, illustrated therein are antenna patterns achieved for electronic devices using antenna structures in accordance with the invention. In FIG. 3, the dual antennas' (107,108) received signals are combined substantially out of phase as the device (100), having the impedance element (112) disposed substantially symmetrically between the first electrical circuit (101) and the second electrical circuit (102), is operating in the second mode where the selectably actuatable phase shifter (111) is actuated, thereby causing the signals received by the antennas (107, 108) to be combined substantially out of phase. The antenna pattern 300 is generally uniform, pointing substantially upward along the y-axis 302 with a peak 301 at the zenith of the pattern. Such an antenna pattern is well suited for receiving GPS signals from satellites when the device is outside.

In FIG. 4, the selectively actuatable phase shifter (111) has not been actuated, such that signals received from the first antenna (107) and second antenna (108) are combined substantially in phase. Again, the impedance element (112) is disposed substantially symmetrically between the first electrical circuit (101) and the second electrical circuit (102). As can be seen in FIG. 4, the antenna pattern 400 is doughnut shaped in the upper hemisphere. In other words, it is uniformly azimuthal with a null 401 centrally located at the top along the y-axis 402. Such a pattern is well suited for receiving GPS signals from satellites when the device (100) is indoors, where the signals enter through windows.

To recap, in one embodiment, an electronic device, like a radiotelephone for example is provided having a first housing section and a second housing section. While these sections may be sections of the same housing, in one embodiment the sections are joined by at least one mechanical connector coupling the first housing section and the second housing section. The mechanical connector is disposed at a generally central location along a width of the radiotelephone (the width corresponding to a minor axis of the radiotelephone).

A first electrical circuit is disposed in the first housing section, the first electrical circuit having circuit components disposed thereon providing the electrical functions associated with the first housing section. Likewise, a second electrical circuit is disposed in the second housing section, the second electrical circuit having circuit components disposed thereon for providing the electrical functions associated with the second housing section.

An electrical connector, which in one embodiment comprises an inductor, couples the first electrical circuit and the second electrical circuit through the mechanical connector. The electrical connector is disposed at a substantially symmetric location of the radiotelephone. The electrical connector serves as an electrical separating mechanism for high frequency currents passing between the first electrical circuit and the second electrical circuit.

A first antenna is disposed along an outer edge of the first housing section. A second antenna is disposed along a distal outer edge of the first section. The antennas are connected to one of the first electrical circuit and the second electrical circuit. Disposed between the first antenna and the second antenna is a selectable phase shifter. The selectable phase shifter, which may be selected from the group consisting of transmission lines, baluns and signal processors, SPDT switches and other equivalent devices, when selected, causes signals received by the first antenna and the second antenna to be combined substantially out of phase.

Thus, where the selectable phase shifter is selected, a composite signal of combined substantially out of phase input signals results. Where the selectable phase shifter is not selected, a composite signal of combined substantially in phase input signals results. Either of these two composite signals may be further combined using conventional combining schemes. By way of example, the composite signals, in one of the first electrical circuit and the second electrical circuit, may be further combined to be delivered to the microprocessor and other circuitry for processing. Exemplary methods of combining the signals, which may be carried out in signal processing circuitry disposed on one of the first and second electrical circuits, include different diversity combining schemes, including selection diversity combining, maximal ration combining and equal ration combining, as is known in the art.

Figure 5B:
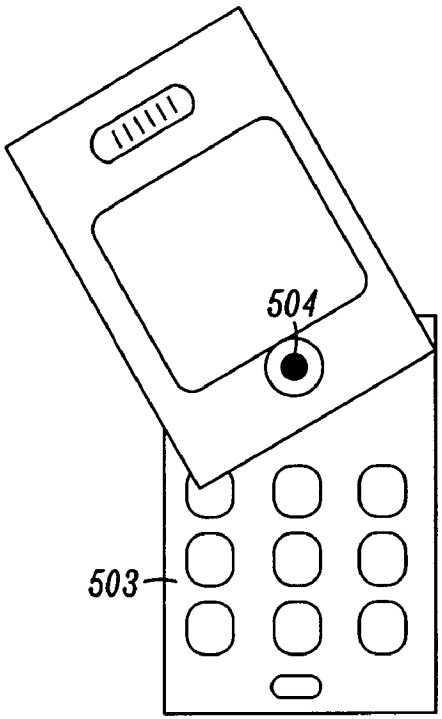
FIGS. 5A, 5B, and 5C illustrate exemplary mechanical connections suitable for use with an antenna structure and associated circuitry in accordance with the invention.
Figure 5A:
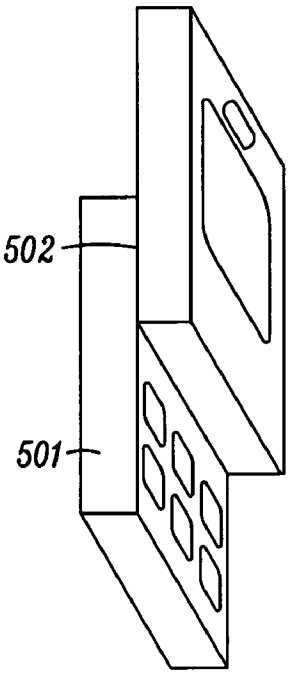
Figure 5C:
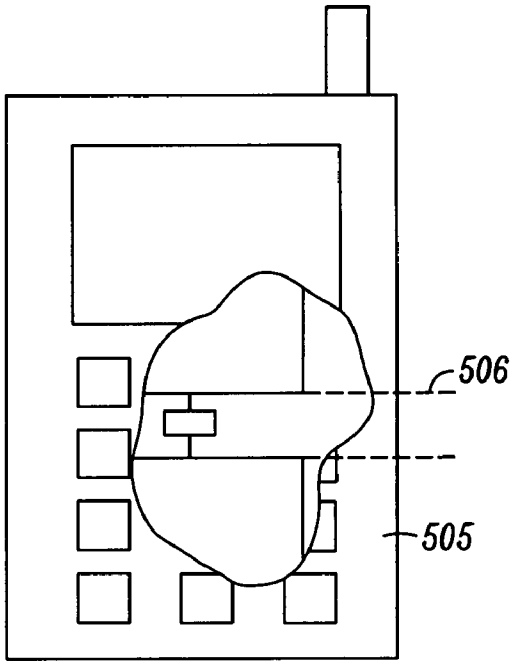

Turning briefly to FIG. 5, illustrated therein are other mechanical connectors that may be used with the present invention. Recall that the impedance element (112) shown in FIG. 1 is used to provide electrical separation between electrical circuits disposed within the device. While the illustrative embodiment of FIG. 1 included a hinged mechanical connection, the invention is not so limited. Other mechanical connections may also be employed. As shown in FIG. 5A, the mechanical connection 502 for the electrical device 501 may be a sliding connection. As shown in FIG. 5B, the mechanical connection 504 of the device may be a rotating connection. As shown in FIG. 5C, so long as there is an electrical separation between electrical circuits residing with the device, the mechanical connection 506 may simply be the electrical separation that is joined by a mechanical housing of the device 505. As such, the device 505 may have a fixed mechanical connection. These mechanical connections are intended to be exemplary in nature. Other mechanical connections may be substituted while staying within the spirit and scope of the invention.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims.

For example, in one embodiment, the device was described as a radiotelephone. It will be clear to those of ordinary skill in the art having the benefit of this disclosure, however, that the invention is not so limited. The device may equally be selected from the group consisting of radios, telephones, global positioning sensor devices, pagers, personal digital assistants and portable computers. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as critical, required, or essential features or elements of any or all the claims.

What is claimed is:

1. A portable electronic device, comprising:

a. at least a first electrical circuit and a second electrical circuit disposed within a housing of the device, wherein the housing of the device has a major axis and a minor axis;

b. a first antenna disposed substantially parallel to the major axis along an outer portion of the device;

c. a second antenna disposed substantially parallel to the major axis along a distal outer portion of the device, wherein when operating in a first mode, signals received by the first antenna and second antenna are substantially in phase; and d. a complex impedance element coupling the first electrical circuit and the second electrical circuit.

2. The device of claim 1, wherein the housing comprises a first housing section and a second housing section, wherein the first housing section and the second housing section are joined by a separating mechanism.

3. The device of claim 2, wherein the separating mechanism comprises a mechanical connector selected from the group consisting of sliding connectors, rotating connectors and hinged connectors.

4. The device of claim 3, wherein the mechanical connector is disposed at a central location along a line substantially parallel to the minor axis between the first housing section and the second housing section.

5. The device of claim 1, further comprising a selectively actuatable phase shifter coupled between the first antenna and second antenna, wherein when the selectively actuatable phase shifter is actuated, the device operates in a second mode where a phase shift of between 90 and 270 degrees is introduced between the first antenna and the second antenna.

6. The device of claim 5, wherein the device selects between the first mode and the second mode based upon a criterion selected from a quality of service indicator, a strength of signal indicator, an environmental sensor and a user input.

7. The device of claim 5, wherein the phase shift introduced is between 170 and 190 degrees.

8. The device of claim 1, wherein the complex impedance comprises a reactance element, wherein the reactance element is disposed at a central location along an electrical circuit separation line substantially parallel to the minor axis.

9. The device of claim 8, wherein the reactance element is disposed between 25% and 75% across the electrical circuit separation line.

10. The device of claim 9, wherein the reactance element is disposed substantially at a center of the electrical circuit separation line.

11. The device of claim 1, wherein the first antenna and the second antenna are each selected from the group consisting of monopoles and inverted F structures.

12. A hand-held electronic device, comprising:

a. an upper housing comprising an upper electrical circuit and a lower housing comprising a lower electrical circuit;

b. a mechanical connection joining the upper housing and the lower housing;

c. a first antenna coupled to the upper electrical circuit, the first antenna being disposed along a first outer edge of the upper housing;

d. a second antenna coupled to the upper electrical circuit, the second antenna being disposed along a second outer edge of the upper housing; and e. a reactance element coupling the upper electrical circuit and the lower electrical circuit, the reactance element being disposed at a central location along a width of the device.

13. The device of claim 12, wherein the reactance element is inductive.

14. The device of claim 12, wherein an inductance of the reactance element is selected based upon the width of the device.

15. The device of claim 12, further comprising a selectable phase shifter coupled between the first antenna and the second antenna, wherein when the selectable phase shifter is selected, signals received by the first antenna are out of phase with signals received by the second antenna.

16. The device of claim 15, wherein the selectable phase shifter comprises an element selected from the group consisting of transmission lines, baluns and signal processors.

17. The device of claim 12, wherein the device is selected from the group consisting of radios, telephones, radiotelephones, global positioning sensor devices, pagers, personal digital assistants and portable computers.

18. A radiotelephone, comprising:

a. a first section comprising a first electrical circuit and a second section comprising a second electrical circuit;

b. at least one mechanical connector coupling the first section and the second section, wherein the at least one mechanical connector is disposed at a central location along a width of the radiotelephone;

c. an electrical connector comprising at least an inductor, the electrical connector coupling the first electrical circuit and the second electrical circuit through the at least one mechanical connector;

d. a first antenna disposed along an outer edge of the first section;

e. a second antenna disposed along a distal outer edge of the first section; and f. a selectable phase shifter coupling the first antenna and the second antenna;

wherein when the selectable phase shifter is selected, a signal received from the first antenna is out of phase with a signal received from the second antenna.

19. The radiotelephone of claim 18, wherein the mechanical connector is selected from the group consisting of hinges, sliding connectors and rotating connectors, further wherein the selectable phase shifter is selected from the group consisting of transmission lines, baluns and signal processors, further wherein the electrical connector is disposed at a substantially symmetric location of the radiotelephone.

20. The radiotelephone of claim 19, wherein signals from the first antenna and second antenna are combined by one of selection diversity, maximal ratio combining and equal ratio combining.

* * * * *